US009617484B2

(12) United States Patent
Hoehn et al.

(10) Patent No.: US 9,617,484 B2
(45) Date of Patent: Apr. 11, 2017

(54) METHODS AND APPARATUSES FOR HYDROTREATING HYDROCARBONS

(71) Applicant: UOP LLC, Des Plaines, IL (US)

(72) Inventors: Richard K. Hoehn, Mt. Prospect, IL (US); Phillip F. Daly, Palatine, IL (US); Xin X. Zhu, Long Grove, IL (US)

(73) Assignee: UOP LLC, Des Plaines, IL (US)

( * ) Notice: Subject to any disclaimer, the term of this patent is extended or adjusted under 35 U.S.C. 154(b) by 470 days.

(21) Appl. No.: 14/299,838

(22) Filed: Jun. 9, 2014

(65) Prior Publication Data

US 2015/0353844 A1 Dec. 10, 2015

(51) Int. Cl.

| | |
|---|---|
| ***C10G 49/24*** | (2006.01) |
| ***C10G 49/26*** | (2006.01) |
| ***C10G 45/02*** | (2006.01) |
| ***C10G 45/72*** | (2006.01) |
| ***C10G 45/12*** | (2006.01) |
| ***C10G 45/06*** | (2006.01) |

(52) U.S. Cl.

CPC ..... *C10G 49/24* (2013.01); *C10G 45/02* (2013.01); *C10G 45/06* (2013.01); *C10G 45/12* (2013.01); *C10G 45/72* (2013.01); *C10G 49/26* (2013.01); *C10G 2300/202* (2013.01); *C10G 2300/4031* (2013.01)

(58) Field of Classification Search

CPC ..... C10G 45/02; C10G 45/72; C10G 49/24; C10G 49/26

See application file for complete search history.

(56) References Cited

U.S. PATENT DOCUMENTS

| | | | | |
|---|---|---|---|---|
| 3,873,440 | A * | 3/1975 | Hallman | C10G 49/24 208/108 |
| 5,914,029 | A * | 6/1999 | Verachtert, II | C10G 49/00 208/107 |
| 6,623,622 | B2 | 9/2003 | Gupta | |
| 6,787,025 | B2 | 9/2004 | Mukherjee et al. | |
| 7,238,275 | B2 | 7/2007 | Stupin et al. | |
| 8,043,600 | B2 | 10/2011 | Knudsen et al. | |
| 2012/0103868 | A1 | 5/2012 | Dindi et al. | |

(Continued)

OTHER PUBLICATIONS

Reverdy, "Add to Selected Records Aim for Autothermal Operation in Diesel Production," Conference: 2010 AIChE Spring Meeting and 6th Global Congress on Process Safety, 10AIChE, Mar. 21, 2010-Mar. 25, 2010; ISBN-13: 9780816910649, Publisher: American Institute of Chemical Engineers.

(Continued)

*Primary Examiner* — Renee Robinson

(57) ABSTRACT

Methods and apparatuses are provided for hydrotreating hydrocarbons. A method includes heating a start-up oil in a stripper liquid fraction heat exchanger during a start-up period, and heating a reactor with the start-up oil. The start-up oil is discharged from the reactor when the start-up period ends, and a standard operating period begins after the start-up period. A reactor effluent is produced by introducing a hydrocarbon stream into the reactor during the standard operating period, where hydrogen sulfide is produced from an organic sulfur compound in the hydrocarbon stream. Steam is produced in the stripper liquid fraction heat exchanger during the standard operating period.

19 Claims, 4 Drawing Sheets

(56) References Cited

U.S. PATENT DOCUMENTS

| | | | | |
|---|---|---|---|---|
| 2013/0152459 | A1 | 6/2013 | Banerjee et al. | |
| 2014/0124408 | A1* | 5/2014 | Zeng | C10G 49/24 208/57 |

OTHER PUBLICATIONS

"Hydroprocessing," Conference: National Petrochemical and Refiners Association—NPRA Q and A Technology Forum 2010, Oct. 10, 2010-Oct. 13, 2010, ISBN-13: 9781618399229, Publisher: National Petrochemical and Refiners Association.

* cited by examiner

METHODS AND APPARATUSES FOR HYDROTREATING HYDROCARBONS

FIELD OF THE INVENTION

The present disclosure generally relates to methods and apparatuses for hydrotreating hydrocarbon streams, and more particularly relates to methods and apparatuses for hydrotreating hydrocarbon streams with low energy use.

BACKGROUND

Hydrotreating is a catalytic process for removing sulfur and nitrogen compounds from hydrocarbons. In the hydrotreating process, the hydrocarbon stream is typically passed through a bed of catalyst at reaction temperatures. Thiols, sulfones, sulfoxides, and other sulfur containing organic compounds are reacted to produce hydrogen sulfide, and nitrogen compounds are reacted to form ammonia. Many catalysts in the oil refining process are poisoned by sulfur compounds, and various regulatory bodies limit the amount of sulfur and nitrogen in many fuels. As such, hydrotreating is a useful process that is frequently used in oil refineries and other chemical processing plants.

Hydrotreating is energy intensive due to severe process conditions, such as high temperatures and pressures. For example, in some embodiments the hydrotreating process uses reaction temperatures of about 300 to about 400 degrees centigrade (° C.) and pressures of about 30 to about 130 atmospheres. Fired heaters are commonly used to pre-heat the hydrocarbon feed stream, and elimination of the fired heater could reduce the energy requirements of the hydrotreating process. The conversion of thiols to hydrogen sulfide is an exothermic reaction, and it would be desirable if the exothermic heat load, or the heat produced by the reaction, could be used to provide the heat needed to pre-heat the hydrocarbon feed stream. The hydrotreating process typically uses several pieces of chemical processing equipment, so it is desirable to limit the capital cost required to install additional equipment to efficiently recover the exothermic heat load.

Accordingly, it is desirable to develop methods and apparatuses for hydrotreating hydrocarbons using the exothermic heat load from the conversion of organic sulfur compounds to hydrogen sulfide to provide essentially all of the heat for preheating the hydrocarbon feed stream. In addition, it is desirable to develop methods and apparatuses for limiting the equipment needed to recover heat in the hydrotreating process. Furthermore, other desirable features and characteristics of the present embodiment will become apparent from the subsequent detailed description and the appended claims, taken in conjunction with the accompanying drawings and this background.

SUMMARY OF THE INVENTION

Methods and apparatuses for hydrotreating hydrocarbons are provided. In an exemplary embodiment, a method includes heating a start-up oil in a stripper liquid fraction heat exchanger during a start-up period, and heating a reactor with the start-up oil. The start-up oil is discharged from the reactor when the start-up period ends, and a standard operating period begins after the start-up period. A reactor effluent is produced by introducing a hydrocarbon stream into the reactor during the standard operating period, where hydrogen sulfide is produced from an organic sulfur compound in the hydrocarbon stream. Steam is produced in the stripper liquid fraction heat exchanger during the standard operating period.

In accordance with another exemplary embodiment, a method for hydrotreating hydrocarbons is provided. A hydrocarbon stream is fed into a reactor during a standard operating period, where the hydrocarbon stream includes an organic sulfur compound. The organic sulfur compound is reacted with hydrogen in the reactor to form hydrogen sulfide and an exothermic heat load. The hydrocarbon stream is heated from a hydrocarbon feed stream initial temperature of about 100 degrees centigrade or less to a reactor entry temperature of about 280 degrees centigrade or more with the exothermic heat load, where the exothermic heat load provides about 98% or more of the heat to raise the hydrocarbon feed stream initial temperature to the reactor entry temperature.

In accordance with a further exemplary embodiment, an apparatus for hydrotreating hydrocarbons is provided. The apparatus includes a reactor and a gas separator fluidly coupled to the reactor. A stripper is fluidly coupled to the gas separator, where the stripper includes a stripper liquid fraction outlet. A stripper liquid fraction heat exchanger is fluidly coupled to the stripper liquid fraction outlet, where the stripper liquid fraction heat exchanger includes a water side and a hydrocarbon side, and where the stripper liquid fraction outlet is fluidly coupled to the hydrocarbon side. A steam feed stream is coupled to the water side of the stripper liquid fraction heat exchange, and a liquid water stream is also coupled to the water side of the stripper liquid fraction heat exchanger. A switching system is connected to the steam feed stream and the liquid water stream, where the switching system is configured to fluidly couple the steam feed stream to the water side while blocking the liquid water stream to the water, or to fluidly couple the liquid water stream to the water side while blocking the steam feed stream from the water side.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the application and uses of the embodiment described. Furthermore, there is no intention to be bound by any theory presented in the preceding background or the following detailed description.

The various embodiments described herein relate to methods and apparatuses for hydrotreating a hydrocarbon stream. Organic sulfur compounds in a hydrocarbon stream are reacted to form hydrogen sulfide while contacting a catalyst in a reactor, which produces an exothermic heat load and a reactor effluent with a reduced concentration of organic sulfur compounds. The exothermic heat load from the reactor provides heat used to pre-heat the hydrocarbon stream before entering the reactor, and thereby reduces the hydrotreating unit energy requirements over a hydrotreater using a fired burner to pre-heat the hydrocarbon stream. In some embodiments, the exothermic heat load provides essentially all the heat used to pre-heat the hydrocarbon stream. The hydrocarbons pass to a gas separator to remove excess hydrogen gas, and then to a stripper to remove hydrogen sulfide and other light gases. A stripper liquid fraction stream flows to a stripper liquid fraction heat exchanger. The stripper liquid fraction heat exchanger is used as a boiler to produce steam in a standard operating period, and as a condenser and heater in a start-up period, and this dual use limits the number of heat exchangers in the hydrotreating unit.

Figure 1:
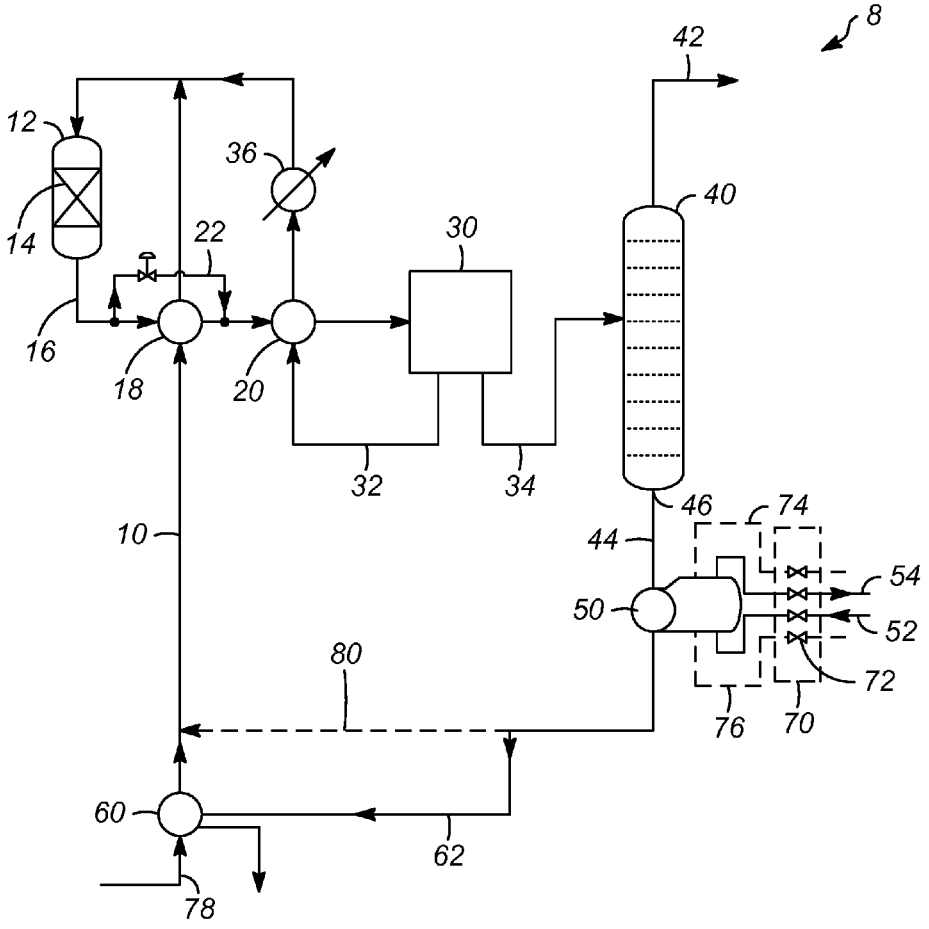
FIG. 1 is a schematic diagram of an exemplary embodiment of an apparatus and method for hydrotreating hydrocarbons in a standard operating period, where the dashed lines represent lines where fluid flow is blocked.

Reference is made to the exemplary method and apparatus illustrated in FIG. 1, where FIG. 1 illustrates the standard operating period for a hydrotreating unit 8 with the dashed line indicating lines with no flow. A hydrocarbon stream 10 is feed to a reactor 12 where it contacts a catalyst 14 within the reactor 12. Organic sulfur compounds in the hydrocarbon stream 10 react exothermically with hydrogen to produce hydrogen sulfide, and the standard operating period is generally when a hydrocarbon stream 10 is passed through the reactor 12 for the purpose of removing organic sulfur compounds. In some embodiments the concentration of organic sulfur compounds is high enough to produce an exothermic heat load sufficient to heat the hydrocarbon stream 10 from a hydrocarbon feed stream initial temperature of about 100° C. or less to a reactor entry temperature of about 280° C. or more. In an exemplary embodiment, the hydrocarbon stream 10 includes organic sulfur compounds such that about 0.2 mass percent or more of the hydrocarbon stream is elemental sulfur, measured by the mass of the elemental sulfur within the hydrocarbon stream 10. In some embodiments, the hydrocarbon stream 10 includes organic sulfur compounds such that the elemental sulfur forms about 0.2 to about 3 mass percent of the hydrocarbon stream 10. In some embodiments, the hydrocarbon stream contains nitrogen compounds at a concentration of from about 100 to about 3,000 parts per million by mass (ppm), as measured from the mass of the elemental nitrogen within the entire hydrocarbon stream 10. However, other concentrations of nitrogen and/or organic sulfur compounds are also possible. The concentration of organic sulfur and nitrogen compounds may be sufficient to produce an exothermic heat load of about 30 watts or more per kilogram of hydrocarbon stream 10, such as from about 30 to about 130 watts per kilogram of hydrocarbon stream 10.

The hydrocarbon stream 10 may be a diesel boiling range material in some embodiments, such that the hydrocarbon stream 10 has a boiling temperature of from about 100° C. to about 400° C. at atmospheric pressure. Contacting the hydrocarbon stream 10 with the catalyst 14 in the reactor 12 may reduce the organic sulfur compounds to about 10 ppm or less in some embodiments, such that the resulting diesel fuel meets limits set by various regulatory agencies for sulfur. In alternate embodiments, the hydrocarbon stream is a kerosene boiling range material, a naphtha boiling range material, or other materials.

The reactor 12 is configured to contain the catalyst 14 for hydrotreating hydrocarbons. The reactor 12 may include one or more catalyst beds, and the reactor 12 may include one or more reactors 12, which may be configured in series or parallel. An example of a suitable catalyst 14 is a hydrotreating catalyst that causes thiols and other organic sulfur compounds to react and produce hydrogen sulfide. The catalyst 14 may also cause amines, amides, and other organic nitrogen containing compounds to react and produce ammonia. The catalyst 14 may saturate some carbon-carbon double bonds in some embodiments, but in other embodiments the reactor 12 and catalyst 14 are operated such that carbon-carbon double bonds are not saturated or such saturation is minimized The molecular weight of most hydrocarbons is not changed in the reactor 12 during the hydrotreating process. In an exemplary embodiment, the reactor 12 operates at a temperature of from about 290° C. to about 400° C., and a pressure of from about 20 to about 140 atmospheres. The reaction conditions are generally more severe as the catalyst 14 ages and becomes less active, and for hydrocarbon streams with higher boiling points, where more severe reaction conditions include higher temperatures and/or pressures. Reaction conditions may also be adjusted for variations in the concentration of olefins in the hydrocarbon stream 10, the concentration of organic sulfur compounds, nitrogen compounds, metals, and a wide variety of other variables.

In some embodiments, the hydrotreating catalyst 14 contains a Group VI and/or Group VIII active metal component on a support, where the support may be a porous refractory oxide including, but not limited to, alumina, alumina-silica, silica, titania, zirconia, boria, magnesia, and their combinations. Supports other than refractory oxides are also possible in various embodiments. In some embodiments, other metals are included in the catalyst 14 in addition to or in place of the Group VI and/or Group VIII metals, such as cobalt, nickel, or other metals. For example, metals that may be used in hydrotreating catalyst 14 include molybdenum, ruthenium, cobalt, nickel, tungsten, and combinations thereof. This type of catalyst 14 can be prepared by combining the active metals with the support. The supports, which may contain metal components, are typically dried and calcined at temperatures ranging from about 370° C. to about to 600° C. to eliminate any solvent and to convert metals to the oxide form, but other catalyst preparation processes are also possible. The calcined metal oxide catalysts may be reacted with sulfur to produce a metal sulfide, such as by contact with a sulfur containing compound including but not limited to hydrogen sulfide, organo sulfur compounds or elemental sulfur.

A reactor effluent 16 exits the reactor 12 and flows through an optional reactor effluent first heat exchanger 18 and an optional reactor effluent second heat exchanger 20 before entering a gas separator 30. As such, the reactor 12 is fluidly connected to the gas separator 30. The reactor effluent first heat exchanger 18 heats the hydrocarbon stream 10 before the hydrocarbon stream 10 enters the reactor 12, and the reactor effluent first heat exchanger 18 also cools the reactor effluent 16. A reactor effluent by-pass 22 may be included to aid in controlling the temperature of the reactor effluent 16 and the hydrocarbon stream 10, where the reactor effluent by-pass 22 allows the reactor effluent 16 to by-pass the reactor effluent first heat exchanger 18. In an alternate embodiment (not illustrated) the reactor effluent by-pass 22 may be designed such that the hydrocarbon stream 10, or a portion thereof, by-passes the first heat exchanger 18. The reactor effluent by-pass 22 may allow for by-passing the reactor effluent second heat exchanger 20 in some embodiments, and there may be one or more reactor effluent by-passes 22 for one or more heat exchangers in the line containing the reactor effluent 16.

The gas separator 30, described in greater detail below, separates the reactor effluent 16 into a recycle gas stream 32 and a gas separator liquid effluent 34. Hydrogen reacts with the organic sulfur compounds in the hydrocarbon stream 10, and excess hydrogen remains in the reactor effluent 16. This excess hydrogen is recovered in the gas separator 30 and returned to the reactor 12 in the recycle gas stream 32. The recycle gas stream 32 may also contain hydrogen sulfide and ammonia, as well as other non-condensables such as nitrogen. The recycle gas stream 32 may be heated in the reactor effluent second heat exchanger 20 before entering the reactor 12. The recycle gas stream 32 may also be further heated in a supplemental heater 36, but in some embodiments the supplemental heater 36 is not needed in the standard operating period. The process may include a make-up hydrogen line (not illustrated) to add hydrogen to the hydrotreating unit 8. The separator 30 may include one or more gas/liquid separation operations in various embodiments.

The gas separator 30 is fluidly connected to a stripper 40, where the gas separator liquid effluent 34 exits the gas separator 30 and flows to the stripper 40. In some embodiments, the gas separator liquid effluent 34 includes hydrocarbons, entrained hydrogen sulfide and ammonia, but there the concentration of organic sulfur compounds in the gas separator liquid effluent 34 is less than the concentration of organic sulfur compounds in the hydrocarbon stream 10. In an exemplary embodiment, the gas separator liquid effluent 34 exits the gas separator at about 35° C. to about 70° C., and a pressure of from about 10 to about 30 atmospheres, but other temperatures and pressures are also possible. The stripper 40 separates the gas separator liquid effluent 34 into a stripper vapor fraction stream 42 and a stripper liquid fraction stream 44, where remaining hydrogen sulfide and ammonia in the gas separator liquid effluent 34 exit the stripper 40 in the stripper vapor fraction stream 42. Most hydrocarbons from the hydrocarbon stream 10 exit the stripper 40 in the stripper liquid fraction stream 44. In an exemplary embodiment, the stripper 40 operates at a pressure of from about 3 to about 15 atmospheres and a temperature of from about 200° C. to about 300° C. at the stripper bottoms, and a pressure of from about 2 to about 14 atmospheres and a temperature of about 150° C. to about 200° C. at the overheads.

Figure 2:
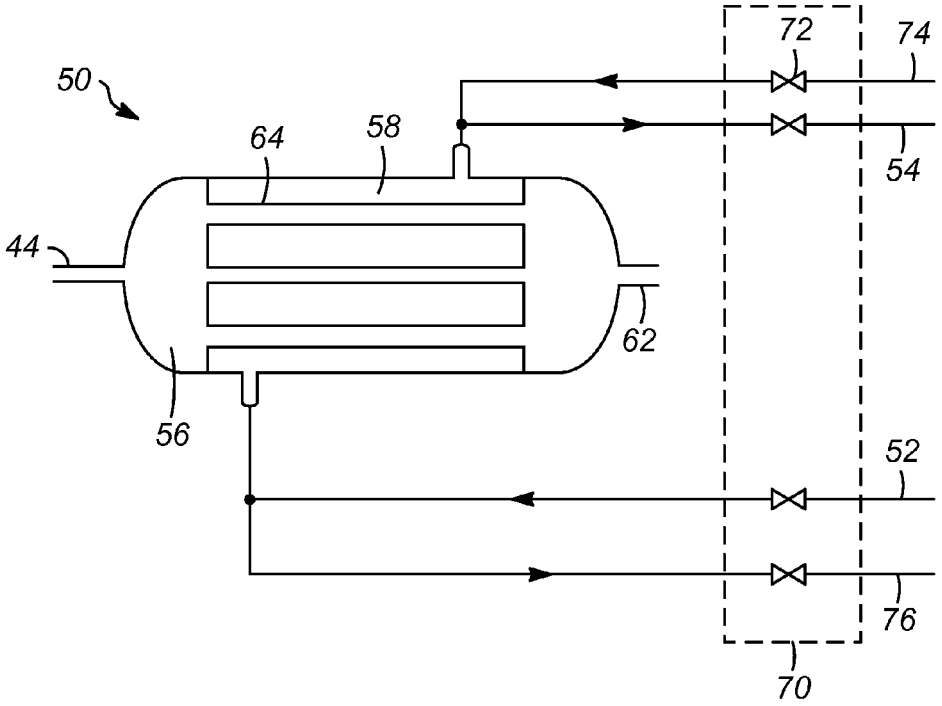
FIG. 2 is a schematic diagram of an exemplary embodiment of a stripper liquid fraction heat exchanger and a switching system.

Reference is now made to FIG. 2, with continuing reference to FIG. 1. The stripper 40 includes a stripper liquid fraction outlet 46 fluidly connected to a stripper liquid fraction heat exchanger 50, and the stripper liquid fraction stream 44 flows through the stripper liquid fraction outlet 46 to the stripper liquid fraction heat exchanger 50. In the standard operating phase, the stripper liquid fraction heat exchanger 50 operates as a boiler to produce steam from a liquid water stream 52, thereby producing a steam discharge stream 54. The steam discharge stream 54 may be added to a plant steam supply system or otherwise used in a wide variety of manners. The stripper liquid fraction stream 44 flows through a hydrocarbon side 56 of the stripper liquid fraction heat exchanger 50, and the liquid water stream 52 flows into a water side 58 of the stripper liquid fraction heat exchanger 50.

After flowing through the stripper liquid fraction heat exchanger 50, the stripper liquid fraction stream 44 then flows through a stripper liquid fraction discharge line 62 to an optional hydrocarbon stream pre-heater 60, and may then be transferred to a storage tank (not illustrated) or to other process units for further processing. In an exemplary embodiment, the hydrocarbon stream 10 and the recycle gas stream 32 are essentially entirely heated by the exothermic heat load from the reactor 12. For example, about 98 percent or more of the heat used to heat the hydrocarbon stream 10 from the hydrocarbon feed stream initial temperature of about 100° C. or less to the reactor entry temperature of about 280° C. or more is provided by the exothermic heat load from the reactor 12, as described above. Heat from the reactor 12 is transferred to the hydrocarbon stream 10 in the hydrocarbon stream pre-heater 60 and the reactor effluent first and second heat exchangers 18, 20. Some of the heat for the hydrocarbon stream 10 may be provided by heating the recycle gas stream 32 in the supplemental heater 36 and/or the reactor effluent second heat exchanger 20, which is then combined with the hydrocarbon stream 10 either before or after entry into the reactor 12.

Figure 3:
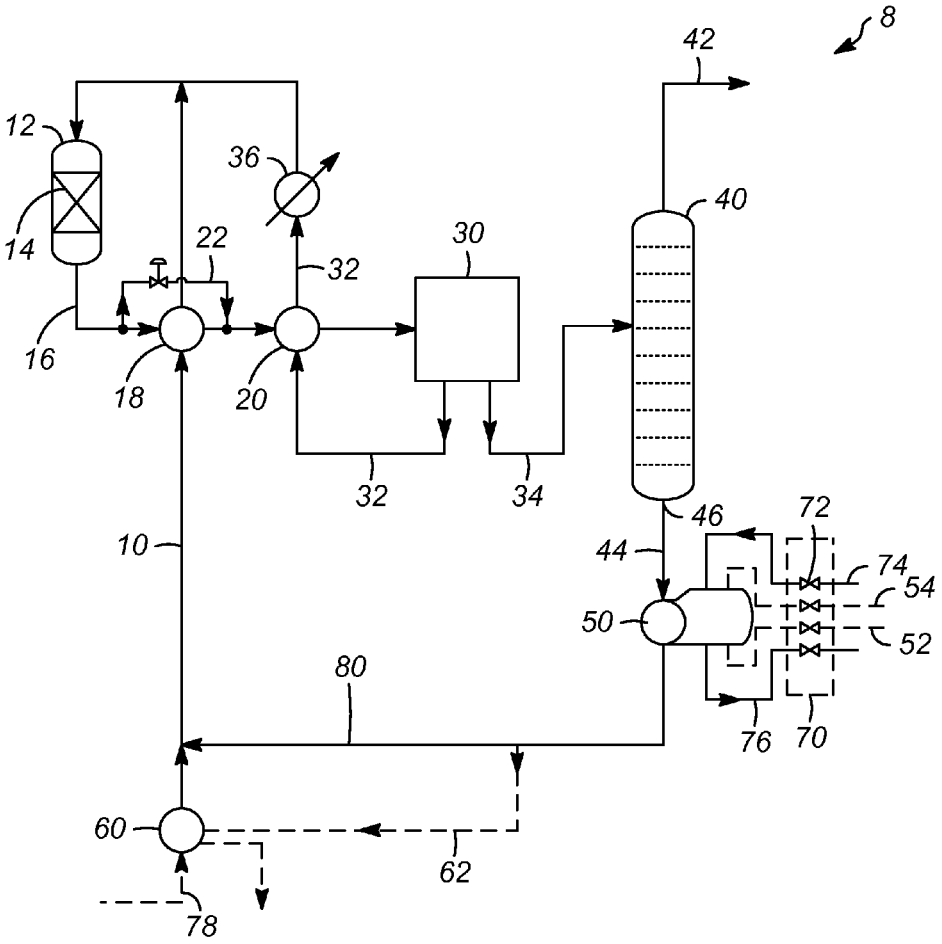
FIG. 3 is a schematic diagram of an exemplary embodiment of an apparatus and method for hydrotreating hydrocarbons in a start-up period, where the dashed lines represent lines where fluid flow is blocked.

A start-up period is required for the hydrotreating unit 8, as illustrated in an exemplary embodiment in FIG. 3 with continuing reference to FIGS. 1 and 2, where the dashed lines indicate lines with no flow. In an exemplary embodiment, the start-up period is before a hydrocarbon stream 10 is introduced into the reactor 12 for the purpose of removing organic sulfur compounds, and may include a transition period when the hydrotreating unit 8 is gradually switched from the start-up period to the standard operating period with limited hydrocarbon stream 10 flow. A switching system 70 may be used to switch the stripper liquid fraction heat exchanger 50 from one configuration for the standard operating period to another configuration for the start-up period. In an exemplary embodiment, the switching system 70 includes a plurality of valves 72 on the lines fluidly connected to the water side 58 of the stripper liquid fraction heat exchanger 50. The switching system 70 facilitates changing the lines on the water side 58 of the stripper liquid fraction heat exchanger 50 such that the stripper liquid fraction heat exchanger 50 heats the hydrocarbons in the hydrocarbon side 56 during the start-up period, and cools the hydrocarbons on the hydrocarbon side 56 during the standard operating period by functioning as a boiler.

As best seen in FIG. 2, the switching system 70 fluidly connects the liquid water stream 52 and the steam discharge stream 54 to the water side 58 of the stripper liquid fraction heat exchanger 50 for steam produced during the standard operating period, and simultaneously blocks a steam feed stream 74 that feeds steam to the stripper liquid fraction heat exchanger 50, and a condensate stream 76 to drain condensate from the stripper liquid fraction heat exchanger 50 as steam from the steam feed stream 74 condenses. In an exemplary embodiment, the liquid water stream 52 is introduced at or near the bottom of the liquid fraction heat exchanger 50, and the steam discharge stream 54 exits at or near a top end of the liquid fraction heat exchanger 50. In the start-up period the switching system 70 fluidly connects the steam feed stream 74 and the condensate stream 76 to the water side 58 while blocking the steam discharge stream 54 and the liquid water stream 52 from the water side 58. During the standard operating period, the liquid water stream 52 may be introduced at or near the bottom of the liquid fraction heat exchanger 50, and the steam discharge stream 54 may be discharged at or near the top of the liquid fraction heat exchanger 50. When switching from one mode of operation to another, the input and output streams from one mode of operation (such as heating for the start-up period) may be completely stopped before opening the input and output streams for the other mode of operation. Therefore, the liquid water stream 52 and the condensate stream 76 are not simultaneously flowing, and the steam discharge stream 54 and the steam feed stream 74 are not simultaneiously flowing. Hydrocarbons from the stripper liquid fraction stream 44 pass through the hydrocarbon side 56 of the stripper liquid fraction heat exchanger 50 in both the standard operating and start-up periods. In the standard operating period, the hydrocarbons exiting the stripper liquid fraction heat exchanger 50 are directed to the stripper liquid fraction discharge line 62, as illustrated, but in the start-up period the hydrocarbons exiting the stripper liquid fraction heat exchanger 50 are directed to a stripper liquid fraction recirculation line 80, described below.

As such, the stripper liquid fraction heat exchanger 50 serves as both a condenser when heating hydrocarbons, and as a boiler when producing steam, so separate heat exchangers are not needed. In an exemplary embodiment, the stripper liquid fraction heat exchanger 50 is a shell and tube heat exchanger, where the water side 58 is on the outside of the tubes 64. Smooth tubes may be used in some embodiments, but boiling tubes can also be used. Boiling tubes include small cavities (not illustrated) formed on the surface of the tube 64, where the cavity is sized to boil the liquid of choice. Boiling tubes can increase boiling efficiency significantly, and can also include ribs, ridges, or other surface geometries (not illustrated) that help shed condensate such that the boiling tube can also improve condensation efficiency over a smooth tube. The design of the heat exchanger can include tube supports and other known components (not illustrated) for condensation and evaporation, and the stripper liquid fraction heat exchanger 50 can be sized for the service requiring the highest heat transfer surface area. In alternate embodiments, the water side 58 may be on the inside of the tubes 64, or other types of heat exchangers can be used, as in understood by those skilled in the art.

In an exemplary embodiment, the heat duties for both the boiling service and the condensing service for the stripper liquid fraction heat exchanger 50 are made consistent, or within about 50% of each other. This includes the calculating the heat duty considering the mean temperature difference on the tube side and on the shell side of the stripper liquid fraction heat exchanger 50, and the heat transfer coefficients. It is noted that relatively high heat transfer coeffiecients for steam condensation are possible using the outside of a tube 64 that does not include tube surface enhancements, flow baffles, or high velocities. Therefore, a bundle of tubes 64 designed to generate steam on the outside of the tubes 64 can also achieve good heat transfer coefficients when condensing steam. Proper tube supports and impingement protection may be included in the design to minimize or reduce impediment of the flow of boiling water or condensing water on the outside of the tubes 64, and to protect and support the bundle of tubes 64 while controlling flow-induced tube vibration damage. In an alternate embodiment, the stripper liquid fraction heat exchanger 50 is sized for whichever heat duty is larger, boiling or condensing steam, and the stripper liquid fraction heat exchanger 50 is oversized for the other purpose.

Reference is made to FIG. 3 again, with continuing reference to FIG. 2. During the start-up period, a start-up oil is recirculated through the hydrotreating unit 8, including the reactor 12, the gas separator 30, and the stripper 40. Suitable start-up oil includes a hydrocarbon with low concentrations of organic sulfur compounds and nitrogen compounds, so there is very little or no exothermic heat load from the reaction of organic sulfur compounds in the reactor 12. Many different hydrocarbons can be used for the start-up oil in various embodiments. In an exemplary embodiment, the start-up oil is introduced into the hydrotreating unit 8 via the hydrocarbon introduction line 78 until the hydrotreating unit 8 has the proper inventory of liquid. Start-up oil introduction is terminated when the desired liquid levels have been established in the reactor 12, the gas separator 30, and the stripper 40, and the start-up oil is recirculated through the hydrotreating unit 8 using a stripper liquid fraction recirculation line 80. The start-up oil is heated, and the heated start-up oil heats the reactor 12, the gas separator 30, the stripper 40, connecting lines and other components while being recirculated. In an exemplary embodiment, the stripper liquid fraction heat exchanger 50 heats the start-up oil as it recirculates through the hydrotreating unit 8 by condensing steam on the water side 58 while the start-up oil flows through the hydrocarbon side 56.

The hydrocarbon stream 10 is introduced to the hydrotreating unit 8 in a hydrocarbon introduction line 78. The hydrocarbon introduction line 78 is generally not in use during the start-up period, except for the initial charge of the start-up oil and during the transition from the start-up period to the standard operating period. In the exemplary embodiment illustrated in FIG. 3, the stripper liquid fraction stream 44 (which includes the start-up oil in the start-up period) is recirculated through the hydrotreating unit 8 using a stripper liquid fraction recirculation line 80, while the stripper liquid fraction discharge line 62 is not in use. A plurality of valves can be used to block the hydrocarbon introduction line 78 and the stripper liquid fraction discharge line 62 while opening the stripper liquid fraction recirculation line 80 for the start-up period, and the same or different valves can be used to block the stripper liquid fraction recirculation line 80 and open the stripper liquid fraction discharge line 62 and the hydrocarbon introduction line 78 for the standard operation period. The valves may be automated or manual, and the operation of the valves may or may not be coordinated with the operation of the switching system 70 for changing the stripper liquid fraction heat exchanger 50 from a condenser to a boiler and back, as described above. There are multiple configurations for the valves and switching system 70 used to change from the start-up period to the standard operating period and back, as is understood by those skilled in the art. In an exemplary embodiment, the transition from the start-up period to the standard operations period involves a gradual increase in flow of the hydrocarbon introduction line 78, and this flow is matched by a gradual increase in flow of the stripper liquid fraction discharge line 62 to maintain the liquid inventory in the hydrotreating unit 8. The flow in the stripper liquid fraction recirculation line 80 is gradually reduced as flow is increased in the stripper liquid fraction discharge line 62, and the start-up oil is gradually discharged from from the reactor 12 and the hydrotreating unit 8 in the stripper liquid fraction discharge line 62. Therefore, the start-up oil is discharged from the hydrotreating unit 8 at about the end of the start-up period, and the hydrocarbon introduction line 78 is used to introduce the hydrocarbon stream 10 to the hydrotreating unit 8 in the standard operating period, where the standard operating period begins after the start-up period ends.

The stripper liquid fraction heat exchanger 50 cannot heat the start-up oil to a temperature greater than the temperature of the steam in the steam feed stream 74. The temperature of the steam feed stream 74 can be changed in various embodiments, and is typically changed by using steam with a different pressure. For example, steam at about 10 atmospheres of pressure (about 150 pounds per square inch) has a saturation temperature of about 180° C., and steam at about 20 atmospheres of pressure (about 300 pounds per square inch) has a saturation temperature of about 210° C. Higher temperatures are possible with higher pressure steam.

In some embodiments, the components of the hydrotreating unit 8 are heated to about 290° C. or greater, or about 310° C. or greater in other embodiments. As such, in some embodiments the steam in the steam feed stream 74 cannot heat the start-up oil to the desired temperature to change the hydrotreating unit 8 from the start-up period to the standard operating period. The supplemental heater 36 is used to provide additional heat to increase the temperature of the hydrotreating unit 8 to the desired temperature to change from the start-up period to the standard operating period. The supplemental heater 36 may use electricity to produce heat for the recycle gas stream 32, and the hot recycle gas stream 32 is then combined with the start-up oil to heat the start-up oil. High temperatures on the heating elements of an electric heater may produce coke or carbon build-up when contacting a liquid oil stream, so the supplemental heater 36 may be positioned in the recycle gas stream 32 instead of in direct contact with the start-up oil. In alternate embodiments (not illustrated), the supplemental heater 36 may be a fired heater or other type of heater, and may be positioned to directly heat the start-up oil. In yet other embodiments, the temperature of the steam in the steam feed stream 74 is sufficiently high to heat the start-up oil to the desired temperature, and no supplemental heater 36 is needed or present.

Figure 4:
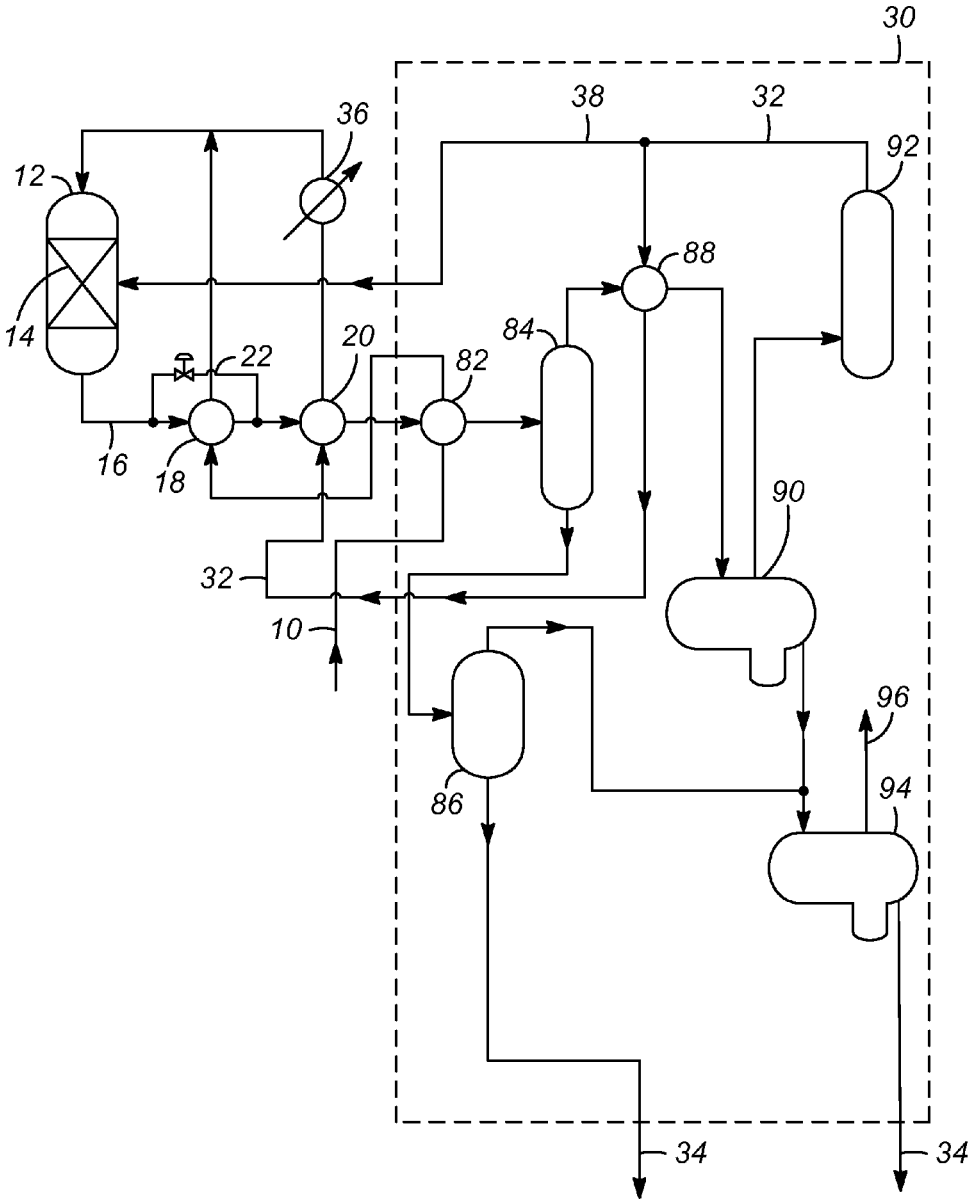
FIG. 4 is a schematic diagram of an exemplary embodiment of a gas separator in a hydrotreating unit.

There are several possible configurations for the gas separator 30, where one exemplary embodiment is illustrated in greater detail in FIG. 4 with continuing reference to FIG. 3. This embodiment includes a reactor effluent third heat exchanger 82 positioned to cool the reactor effluent 16 and heat the hydrocarbon stream 10. The reactor effluent 16 passes through the reactor effluent third heat exchanger 82 and flows into a hot separator 84, which may operate at a temperature of from about 200° C. to about 370° C. and a pressure of from about 20 to about 140 atmospheres. Liquids from the hot separator 84 flow to a hot flash drum 86, where the hot flash drum 86 may be operated at about the same temperature as the hot separator 84 described above and substantially the same pressure as the cold flash drum 94 described below. Liquids from the hot flash drum 86 may then flow to the stripper 40 in the gas separator liquid effluent 34, and vapors from the hot flash drum 86 may flow to a cold flash drum 94, described below. There may be more than one gas separator liquid effluent 34 exiting the gas separator 30 and flowing to the stripper 40, and different gas separator liquid effluents 34 may enter the stripper 40 at different locations.

Gases from the hot separator 84 may flow through a hot separator heat exchanger 88 to partially heat the recycle gas stream 32, and then flow into a cold separator 90. The cold separator 90 may include a pressure controller for maintaining the pressure in the reactor section by controlling the addition of makeup gas (not illustrated). As such, the pressure in the cold separator 90 may be substantially the same pressure as in the reactor 12, except that the pressure in the cold separator 90 will be somewhat lower due to friction losses as the reactor effluent 16 flows from the reactor 12 to the cold separator 90. The temperature of the cold separator 90 may be about 35° C. to about 70° C. Vapors from the cold separator 90 may pass through an amine absorber 92 to remove excess hydrogen sulfide and leave hydrogen gas, and the hydrogen is then returned to the reactor 12 in the recycle gas stream 32. A reactor quench stream 38 may be separated from the recycle gas stream 32, and the reactor quench stream 38 can be added to the reactor 12 with little or no additional heating to help control the temperature in the reactor 12.

Liquids from the cold separator 90 are let down in pressure and flow to a cold flash drum 94, which operates at a pressure of from about 10 to about 25 atmospheres and about the same temperature as the cold separator 90 described above. Cold flash drum vapors 96 from the cold flash drum 94 are produced as an offgas and are generally routed to treating facilities (not illustrated). Liquids from the cold flash drum 94 are discharged from the gas separator 30 as the gas separator liquid effluent 34. There are other embodiments for the gas separator 30, as understood by those skilled in the art, and the various embodiments generally serve to separate excess hydrogen gas and light hydrocarbons from the reactor effluent 16.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the application in any way. Rather, the foregoing detailed description will provide those skilled in the art with a convenient road map for implementing one or more embodiments, it being understood that various changes may be made in the function and arrangement of elements described in an exemplary embodiment without departing from the scope, as set forth in the appended claims.

The invention claimed is:

1. A method of hydrotreating hydrocarbons comprising:

heating a start-up oil in a stripper liquid fraction heat exchanger during a start-up period;

heating a reactor with the start-up oil during the start-up period;

discharging the start-up oil from the reactor when the start-up period ends, wherein a standard operating period begins after the start-up period;

feeding a hydrocarbon stream into the reactor during the standard operating period to produce hydrogen sulfide from an organic sulfur compound in the hydrocarbon stream, wherein the reactor produces a reactor effluent; and producing steam in the stripper liquid fraction heat exchanger during the standard operating period.

2. The method of claim 1 further comprising:

separating gases from the reactor effluent in a gas separator during the standard operating period to produce a recycle gas stream and a gas separator liquid effluent.

3. The method of claim 2 further comprising:

fractionating the gas separator liquid effluent in a stripper during the standard operating period to produce a stripper vapor fraction stream and a stripper liquid fraction stream; and wherein producing steam in the stripper liquid fraction heat exchanger during the standard operating period comprises producing steam in the stripper liquid fraction heat exchanger from the stripper liquid fraction stream.

4. The method of claim 3 further comprising heating the gas separator and the stripper with the start-up oil during the start-up period.

5. The method of claim 1 further comprising: heating a recycle gas stream in a supplemental heater during the start-up period; and heating the start-up oil with the recycle gas stream during the start-up period.

6. The method of claim 5 wherein heating the recycle gas stream in the supplemental heater further comprises heating the recycle gas stream in the supplemental heater wherein the supplemental heater produces heat from electricity.

7. The method of claim 1 wherein:

heating the start-up oil in the stripper liquid fraction heat exchanger comprises heating the start-up oil in a hydrocarbon side of the stripper liquid fraction heat exchanger, and condensing steam in a water side of the stripper liquid fraction heat exchanger.

8. The method of claim 7 wherein:

producing steam from the stripper liquid fraction heat exchanger comprises activating a switching system to block a steam feed stream to the water side of the stripper liquid fraction heat exchanger, and wherein the switching system opens a liquid water stream to the water side of the stripper liquid fraction heat exchanger when blocking the steam feed stream.

9. The method of claim 1 further comprising:

feeding a recycle gas stream comprising hydrogen into the reactor; and wherein feeding the hydrocarbon stream into the reactor during the standard operating period comprises reacting the organic sulfur compound in the hydrocarbon stream with the hydrogen in the recycle gas stream to produce the hydrogen sulfide and an exothermic heat load.

10. The method of claim 9 further comprising:

heating the hydrocarbon stream from a hydrocarbon feed stream initial temperature of about 100 degrees centigrade or less to a reactor entry temperature of about 280 degrees centigrade or more, and wherein the exothermic heat load provides about 98% or more of the heat to raise the hydrocarbon feed stream initial temperature to the reactor entry temperature.

11. The method of claim 10 wherein reacting the organic sulfur compound in the hydrocarbon stream comprises reacting the organic sulfur compound in the hydrocarbon stream wherein elemental sulfur within the organic sulfur compound comprises about 0.2 weight percent or more of the hydrocarbon stream.

12. The method of claim 9 wherein reacting the organic sulfur compound in the hydrocarbon stream comprises contacting the hydrocarbon stream with a catalyst in the reactor.

13. The method of claim 12 wherein reacting the organic sulfur compound in the hydrocarbon stream comprises contacting the hydrocarbon stream with the catalyst comprising molybdenum, ruthenium, cobalt, nickel, tungsten, or a combination thereof.

14. The method of claim 1 wherein introducing the hydrocarbon stream into the reactor during the standard operating period comprises introducing the hydrocarbon stream with a boiling temperature from about 100 degrees centigrade to about 400 degrees centigrade at atmospheric pressure, such that the hydrocarbon stream is a diesel boiling range hydrocarbon stream.

15. A method of hydrotreating hydrocarbons comprising:

feeding a hydrocarbon stream into a reactor during a standard operating period, wherein the hydrocarbon stream comprises an organic sulfur compound;

reacting the organic sulfur compound with hydrogen in the reactor to form hydrogen sulfide and an exothermic heat load;

heating the hydrocarbon stream from a hydrocarbon feed stream initial temperature of about 100 degrees centigrade or less to a reactor entry temperature of about 280 degrees centigrade or more with the exothermic heat load, wherein the exothermic heat load provides about 98% or more of the heat to raise the hydrocarbon feed stream initial temperature to the reactor entry temperature;

producing steam from a stripper liquid fraction stream in a stripper liquid fraction heat exchanger during the standard operating period; and heating a start-up oil in the stripper liquid fraction heat exchanger during a start-up period.

16. The method of claim 15 wherein:

producing steam from the stripper liquid fraction stream comprises activating a switching system to block a steam feed stream to a water side of the stripper liquid fraction heat exchanger, and wherein the switching system opens a liquid water stream to the water side of the stripper liquid fraction heat exchanger when blocking the steam feed stream.

17. The method of claim 15 wherein reacting the organic sulfur compound in the hydrocarbon stream comprises reacting the organic sulfur compound in the hydrocarbon stream wherein elemental sulfur within the organic sulfur compound comprises about 0.2 weight percent or more of the hydrocarbon stream.

18. The method of claim 15 wherein introducing the hydrocarbon stream into the reactor during the standard operating period comprises introducing the hydrocarbon stream with a boiling temperature from about 100 degrees centigrade to about 400 degrees centigrade at atmospheric pressure, such that the hydrocarbon stream is a diesel boiling range hydrocarbon stream.

19. An apparatus for hydrotreating hydrocarbons comprising:

a reactor containing a hydrotreating catalyst;

a gas separator fluidly coupled to the reactor;

a stripper fluidly coupled to the gas separator, wherein the stripper comprises a stripper liquid fraction outlet;

a stripper liquid fraction heat exchanger fluidly coupled to the stripper liquid fraction outlet, wherein the stripper liquid fraction heat exchanger comprises a water side and a hydrocarbon side, and wherein the stripper liquid fraction outlet is fluidly coupled to the hydrocarbon side;

a steam feed stream coupled to the water side of the stripper liquid fraction heat exchanger;

a liquid water feed stream coupled to the water side of the stripper liquid fraction heat exchanger; and a switching system connected to the steam feed stream and the liquid water feed stream, wherein the switching system is configured to fluidly couple the steam feed stream to the water side while blocking the liquid water feed stream to the water side, or to fluidly couple the liquid water feed stream to the water side while blocking the steam feed stream from the water side.

* * * * *